US008696534B2

(12) United States Patent
Karwan

(10) Patent No.: US 8,696,534 B2
(45) Date of Patent: Apr. 15, 2014

(54) TOTAL ABS OFFICE CHAIR

(76) Inventor: Sihar Ahmad Karwan, Alexandria, VA (US)

( * ) Notice: Subject to any disclaimer, the term of this patent is extended or adjusted under 35 U.S.C. 154(b) by 0 days.

(21) Appl. No.: 12/457,720

(22) Filed: Jun. 19, 2009

(65) Prior Publication Data

US 2010/0323861 A1 Dec. 23, 2010

(51) Int. Cl.

| | |
|---|---|
| ***A63B 29/00*** | (2006.01) |
| ***A47C 7/00*** | (2006.01) |
| ***A47C 7/50*** | (2006.01) |

(52) U.S. Cl.

USPC ..... 482/145; 482/140; 482/142; 297/68

(58) Field of Classification Search

USPC ..... 482/130, 132, 136, 137, 138, 140, 142, 482/144, 145; 297/353, 354.12, 354.13, 297/377, 311, 217.3, 68–91

See application file for complete search history.

(56) References Cited

U.S. PATENT DOCUMENTS

| | | | | | |
|---|---|---|---|---|---|
| 3,989,297 | A | * | 11/1976 | Kerstholt | 297/300.3 |
| 4,521,053 | A | * | 6/1985 | de Boer | 297/312 |
| 4,765,684 | A | * | 8/1988 | Kvalheim et al. | 297/423.13 |
| 4,767,160 | A | * | 8/1988 | Mengshoel et al. | 297/423.12 |
| 4,832,407 | A | * | 5/1989 | Serber | 297/423.12 |
| 5,044,633 | A | | 9/1991 | Rice | |
| 5,100,131 | A | | 3/1992 | Fong | |
| 5,110,121 | A | * | 5/1992 | Foster | 482/137 |
| 5,425,566 | A | * | 6/1995 | Buchacz | 297/301.2 |
| 5,542,746 | A | * | 8/1996 | Bujaryn | 297/423.12 |
| 5,545,114 | A | | 8/1996 | Gvoich | |
| 5,695,250 | A | | 12/1997 | Lin | |
| 5,782,534 | A | * | 7/1998 | Desanta | 297/423.13 |
| 5,833,590 | A | | 11/1998 | Chiu | |
| 5,871,425 | A | | 2/1999 | Gvoich | |
| 5,967,610 | A | | 10/1999 | Lin | |
| 6,022,303 | A | | 2/2000 | Abdo | |
| 6,113,522 | A | | 9/2000 | Fontenot | |
| 6,149,239 | A | * | 11/2000 | Markussen et al. | 297/423.4 |
| 6,248,047 | B1 | | 6/2001 | Abdo | |
| 6,312,366 | B1 | | 11/2001 | Prusick | |
| D476,045 | S | | 6/2003 | Casey | |
| 6,602,171 | B1 | | 8/2003 | Tsen | |
| 6,746,384 | B2 | | 6/2004 | Cole | |
| D520,084 | S | | 5/2006 | McVay | |
| 7,086,992 | B2 | | 8/2006 | Bowmen | |
| 7,090,303 | B2 | | 8/2006 | Kropa | |
| 7,172,539 | B1 | | 2/2007 | Bythewood | |
| 7,461,896 | B2 | * | 12/2008 | Welles et al. | 297/330 |
| 2002/0043871 | A1 | * | 4/2002 | Prince et al. | 297/452.55 |
| 2002/0140259 | A1 | * | 10/2002 | Wiegand | 297/195.11 |
| 2002/0167206 | A1 | * | 11/2002 | Jalkanen | 297/202 |
| 2004/0056520 | A1 | * | 3/2004 | Cho | 297/218.1 |
| 2005/0001461 | A1 | * | 1/2005 | Caruso et al. | 297/258.1 |
| 2005/0017560 | A1 | * | 1/2005 | Bastas | 297/353 |
| 2005/0082888 | A1 | * | 4/2005 | Williams et al. | 297/250.1 |

(Continued)

FOREIGN PATENT DOCUMENTS

| | | | |
|---|---|---|---|
| WO | WO 2008/133953 | * | 11/2008 |

*Primary Examiner* — Loan Thanh
*Assistant Examiner* — Andrew S Lo

(57) ABSTRACT

An article of furniture suitable for sitting comprising of a seat, a hinging and lowering seatback, and a coaster wheeled pedestal base with a means of securing human feet; whereby providing its user with a fast, convenient, and safe means of seating, stretching, exercising, and laying flat to rest without the article of furniture having to be laboriously manipulated.

21 Claims, 11 Drawing Sheets

(56) References Cited

U.S. PATENT DOCUMENTS

| | | | | |
|---|---|---|---|---|
| 2005/0088029 | A1* | 4/2005 | Stokes | 297/461 |
| 2005/0101460 | A1 | 5/2005 | Lobban | |
| 2005/0189808 | A1* | 9/2005 | Lin | 297/423.21 |
| 2005/0242635 | A1* | 11/2005 | Cassaday | 297/217.3 |
| 2005/0272582 | A1* | 12/2005 | Leib | 482/142 |
| 2006/0103177 | A1* | 5/2006 | Vergara et al. | 297/16.1 |
| 2006/0116259 | A1* | 6/2006 | Smith | 482/130 |
| 2006/0238009 | A1* | 10/2006 | Igarashi et al. | 297/354.12 |
| 2007/0063563 | A1* | 3/2007 | Maze et al. | 297/317 |
| 2007/0284930 | A1* | 12/2007 | Christianson et al. | 297/440.2 |
| 2007/0287618 | A1* | 12/2007 | Verheem | 482/140 |
| 2008/0067850 | A1* | 3/2008 | Stenstrom et al. | 297/353 |
| 2008/0079301 | A1* | 4/2008 | Schaaf | 297/313 |
| 2008/0106132 | A1* | 5/2008 | Glockl et al. | 297/264.1 |
| 2008/0106133 | A1* | 5/2008 | Vrijlandt et al. | 297/302.1 |
| 2008/0191525 | A1* | 8/2008 | Jensen et al. | 297/217.2 |
| 2008/0203776 | A1* | 8/2008 | Mongelluzzo et al. | 297/118 |
| 2008/0254955 | A1 | 10/2008 | Mongelluzzo | |
| 2009/0108648 | A1* | 4/2009 | Biggs et al. | 297/217.1 |
| 2009/0146474 | A1* | 6/2009 | Welles et al. | 297/217.3 |
| 2010/0190623 | A1* | 7/2010 | Guissin et al. | 482/142 |

* cited by examiner

TOTAL ABS OFFICE CHAIR

CROSS-REFERENCE TO RELATED APPLICATIONS

Reference Cited

| U.S. PATENT DOCUMENTS | | | |
|---|---|---|---|
| 5,110,121 | May 1992 | Foster | 482/137 |
| 5,695,250 | December 1997 | Lin | 297/353 |
| 5,967,610 | October 1999 | Lin | 297/340 |
| 5,044,633 | September 1991 | Rice | 272/144 |
| 5,833,590 | November 1998 | Chiu | 482/142 |
| 5,545,114 | August 1996 | Gvoich | 482/140 |
| 5,871,425 | February 1999 | Gvoich | 482/140 |
| 6,113,522 | September 2000 | Fontenot | 482/111 |
| 6,022,303 | February 2000 | Abdo | 482/140 |
| 5,100,131 | March 1992 | Fong | 482/112 |
| US 6,312,366 B1 | November 2001 | Prusick | 482/130 |
| US D520,084 S | May 2006 | McVay | D21/687 |
| US 7,086,992 B2 | August 2006 | Bowmen | 482/51 |
| US 6,248,047 B1 | June 2001 | Abdo | 482/130 |
| US 7,172,539 B1 | February 2007 | Bythewood | 482/140 |
| US D476,045 S | June 2003 | Casey | D21/690 |
| US 6,746,384 B2 | June 2004 | Cole | 482/130 |
| US 6,602,171 B1 | August 2003 | Tsen | 11/422,840 |
| US 7,090,303 B2 | August 2006 | Kropa | 297/466 |
| FOREIGN PATENT DOCUMENTS | | | |
| 10-2006-0027454 | | | |
| OTHER PUBLICATIONS | | | |
| US 2008/0254955 A1 | October 2008 | Mongelluzzo | 482/138 |
| US 2006/0116259 A1 | June 2006 | Smith | 482/130 |
| US 2005/0101460 A1 | May 2005 | Lobban | 26/00 |

CROSS-REFERENCE

Not Applicable

FEDERALLY SPONSORED RESEARCH

Not Applicable

SEQUENCE LISTING OR PROGRAM

Not Applicable

BACKGROUND OF THIS PRESENT EMBODIMENT

1. Field of this Present Embodiment

This present embodiment relates in general to an article of furniture such as an office chair having a seat, a seatback, and a base with coaster wheels. The user can use this present embodiment for the home, office, or such. This embodiment further includes means for the user to exercise or stretch whereby allowing the user a fast, safe, and convenient means and method of seating, stretching, and exercising.

2. Prior Art

By Patent Numbers:

US 2006/0116259 A1 June 2006 Smith 482/130 CHAIR WITH EXERCISE APPARATUS

The disadvantage of Smith's patent application '259 for his chair is that the base has no means to secure human feet. Smith's patent application '259 has an optional hub attachable footrest assembly that has retracting means that may also be used for leg press exercises. Smith's patent application '259 does not allow for the backrest itself to hinge in two to allow the user a broader range of abdominal exercises. Smith's patent application '259 does not allow for the backrest to be completely lowered to rest by touching the floor.

U.S. Pat. No. 7,090,303 B2 August 2006 Kropa 297/466 REHABILITATION TRAINING AND EXERCISE CHAIR The disadvantage of Kropa's patent '303 for his reverse seated chair is that the foot extensions attached to the base are intended for isometric exercises. Although the foot extensions can allow the user to perform isometric abdomen exercises by allowing the user to push forward on the cushioned front support which rests against the user's abdomen, the foot extensions will not secure the user if the user attempts to lean back. The foot extensions are located too far out on each side of the base forcing the user's feet to be spread too far apart. If user's feet and knees are not aligned in a vertical manner, the user's knees will experience a torque when the user attempts to lean back to support their weight. This will cause severe stresses and damage to the user's knees when the user attempts to lean back and support their weight. The foot extensions are suitable for placing only the toes beneath and therefore the user's total weight will be forced on just the toes. The total weight of the user applied on just a small portion of the user's toes will definitely cause pain. Additionally, Kropa's chair does not have an adequate seat front support to apply force on the back of the user's knee to stabilize the user when the user leans back. Even if the foot extensions were able to secure the user's feet, the user will fall backwards if the user attempts to perform abdominal exercises by leaning back because the user's feet are forced too far apart and the back of the user's knee have no support due to the round seat design and the fact that the foot extensions are placed outside of the seat area. If the user attempts to use the abductor extensions to engage the outer thigh to keep them from falling, the user's knee joints will be under torque as stated above which will cause injuries. Additionally, Kropa's patent for his chair '303 does not have a backrest to allow the user to sit comfortably for any extended period of time.

US 2008/0254955 October 2008 Mongelluzzo 482/138 OFFICE AND DESK EXERCISE CHAIR SYSTEM The disadvantage of Mongelluzzo's patent '955 is that it has a leg rest attached to a wheeled base which can be used to rest the user's legs or to perform leg exercises by letting the user push down against the leg rests. The leg rest can be locked in position to allow the user to push against the leg rest and perform twist and swivel motions to work the torso. Mongelluzzo's patent '955 has no means of securing human user's feet. Mongelluzzo's patent '955 requires a base support with "at least about five supports 109". Mongelluzzo's patent '955 for his chair does not allow the backrest to recline completely and touch the floor. Also, Mongelluzzo's chair patent '955 does not allow the backrest itself to hinge in two to allow the user a broader range of abdominal exercises.

U.S. Pat. No. 5,110,121 May 1992 Foster 482/137 EXERCISE CHAIR FOR THE LOWER BACK The disadvantage of Foster's patent '121 for his chair that exercises the lumbar by deploying pelvic stabilizers is that the pelvic stabilizers have to be laboriously manipulated from the armrest before any exercise can be performed. Foster's '121 chair has no apparatus to lock the user's feet and stabilize the user's legs. Foster's chair has no means or method of exercising or stretching the abdomen or legs. Foster's '121 chair must be laboriously manipulated by the user to hold the user's pelvis in place. Foster's '121 chair only allows for 80° of exercise movement and Foster's '121 lumbar support pads cannot be completely moved from the seated user's path, which limits the user's range of motion. Foster's '121 chair requires "a plurality of laterally extending legs, at least a pair of said legs". Foster's '121 chair has lumbar supports pads but no backrest making Foster's '121 chair unable to workout the abdomen. Additionally, the lumbar support pads on Foster's chair '121 prevent the user from leaning fully back restricting the user from fully exercising their abdomen.

U.S. Pat. No. 5,695,250 December 1997 Lin 297/353 CHAIR WITH SWIVEL SEAT AND BACKREST The disadvantage of Lin patent '250 is that it provides a chair with a swivel seat and backrest that limits exercise to only the user's lumbar and does not have a means or a method for the user to lean back to perform abdominal exercises. The user can simply lean forward on an ordinary seat and rotate their upper body to get the same result as Lin's '250 chair making the exercises function on Lin's '250 chair obsolete. Lin's '250 chair has no apparatus to lock the user's feet in place when the user performs exercises. Lin's chair has no means or method of exercising or stretching the legs or abdominal. Lin's chair works on a limited swivel motion and not a lean motion. Also, Lin's '250 chair patent does not allow the backrest itself to hinge in two to allow the user a broader range of abdominal exercises. Lin's '250 chair does not allow the backrest to be lowered.

U.S. Pat. No. 5,967,610 October 1999 Lin 297/340 CHAIR WITH SWIVEL SEAT AND BACKREST The disadvantage of Lin's patent '610 is that it is a continuation of his old patent '250 with the addition of L shaped handles to his chair. The addition of L shaped handles to Lin '250 does not broaden the operation of Lin's '610 chair. The L shaped handles only simplify the operation of the chair to the user, and therefore does not broaden the scope of Lin's '610 chair. The addition of the L shaped handles to Lin's '250 also adds a strangely awkward look to the chair. Lin's '610 chair patent does not allow the backrest itself to hinge in two or allow the backrest to be lowered to allow the user a broader range of abdominal exercises.

U.S. Pat. No. 5,044,633 September 1991 Rice 272/144 OFFICE CHAIR WITH OCCASIONAL EXERCISE CAPABILITY The foot handles of Rice's patent '633 exercise the calf muscles of the legs and thighs but does not exercise the abdominal muscles. Rice's patent '633 shows that the foot handles cannot be locked in place. Rice '633 has no means or method of lowering, reclining, or moving the seatback from the user's way so that the user can perform abdominal exercises. Rice '633 has no apparatus to stabilize the user by locking the user's feet. Rice '633 does not have the means or a method for a user to lean back and perform abdominal exercises. Rice '633 patent has no means or method of exercising or stretching the abdomen. Rice's patent '633 has foot handles that are attached to the seat underside and not to the base making the seat unstable when the foot handles are in use. Rice's patent '633 does not have a stabilizing method for a user to lean back and perform exercises or stretches. Also, Rice's patent '633 for his chair does not allow the backrest itself to hinge in two to allow the user a broader range of abdominal exercises. Rice's patent '633 does not allow for the backrest to be lowered.

FOREIGN PATENT DOCUMENTS 10-2006-0027454

OFFICE CHAIR WITH EXERCISE FUNCTION CAPABLE OF TAKING EXERCISE FOR ARM, LEGS, AND WAIST IN OFFICE WITHOUT MOVING INTO SPECIFIC PLAYGROUND

Patent '454 does not have a base with a means of securing human feet. Also, patent '454 does not allow the backrest itself to hinge in two to allow the user a broader range of abdominal exercises.

The patents listed below have means for the user to exercise but are not office chairs or chairs with a coaster wheeled base suitable for the home, office, or such. The patents listed below are mostly considered as exercise devices such as gym equipment rather then an article of furniture:

| | | | |
|---|---|---|---|
| 5,833,590 | November 1998 | Chiu | 482/142 |
| 5,545,114 | August 1996 | Gvoich | 482/140 |
| 5,871,425 | February 1999 | Gvoich | 482/140 |
| 6,113,522 | September 2000 | Fontenot | 482/111 |
| 6,022,303 | February 2000 | Abdo | 482/140 |
| 5,100,131 | March 1992 | Fong | 482/112 |
| US 6,312,366 B1 | November 2001 | Prusick | 482/130 |
| US D520,084 S | May 2006 | McVay | D21/687 |
| US 7,086,992 B2 | August 2006 | Bowmen | 482/51 |
| US 6,248,047 B1 | June 2001 | Abdo | 482/130 |
| US 7,172,539 B1 | February 2007 | Bythewood | 482/140 |
| US D476,045 S | June 2003 | Casey | D21/690 |
| US 2005/0101460 A1 | May 2005 | Lobban | 26/00 |
| US 6,746,384 B2 | June 2004 | Cole | 482/130 |
| US 6,602,171 B1 | August 2003 | Tsen | 11/422,840 |

BRIEF SUMMARY OF THIS PRESENT EMBODIMENT

This present embodiment exhibits an office chair further including means and methods to allow the user to perform exercises. This present embodiment does not require additional add-ons and looks similar to a traditional office chair when the seatback is locked in the upright position. The user can perform exercises without laboriously manipulating this present embodiment whereby allowing a convenient means and method of exercising. The user can lock his or her feet in the means of securing human feet. When the user lock his or her feet, the user can simply grab the handles located near or on the headrest and pull forward; the seat back itself is allowed to hinge in two by means of hinging. This allows the user to work their upper abs without manipulating this present embodiment whatsoever. This present embodiment enables the user to perform exercises such as sit-ups without the user having to lie on the floor. This present embodiment also cradles the back and tailbone allowing the user to exercise painlessly. The user's back and tailbone is stabilized and cushioned by an inflatable adjustable spine stabilizer air bag. Additionally, the seatback is configured to unlock and be lowered fully to rest on the floor out of the user's way to allow the user to perform strenuous exercises. The fully lowered seatback adds additional stability to the chair and also provides the user with a safe area to rest on with out fear of bumping their head. The lowered seatback provides the user a safe and secure place to rest in between repetitions. Once the user's feet are locked in place by means of securing human feet the user's legs are stabilized and the user can perform exercises by leaning back without fear of falling due to the predetermined elongate support members that are located in the rear of the base to stabilize the user and the chair when the user leans back horizontally. The chair also has means and/or methods to count the number of sit-ups completed and calories burned. This data can be displayed on an armrest display. The data can also be stored and downloaded to a computer (not shown) conventionally known in the art. This present embodiment provides a quick, convenient, easy, and safe means of securing human feet in place without having to be laboriously manipulated to offer the user a greater range of exercise motion.

BRIEF DESCRIPTION OF THE DRAWINGS

Drawings

Figures

FIG. 9A further depicts the securing member for securing human feet and locking at least one wheel 115. The securing member for securing human feet and locking at least one wheel 115 is accomplished by securing one of the plurality of coaster wheels 105 to the securing member for securing human feet 110. The function of the securing member for securing human feet and locking at least one wheel 115 can also be accomplished by the use of Wheel lock actuator 930 and Wheel locks 940.

Figure 1A:
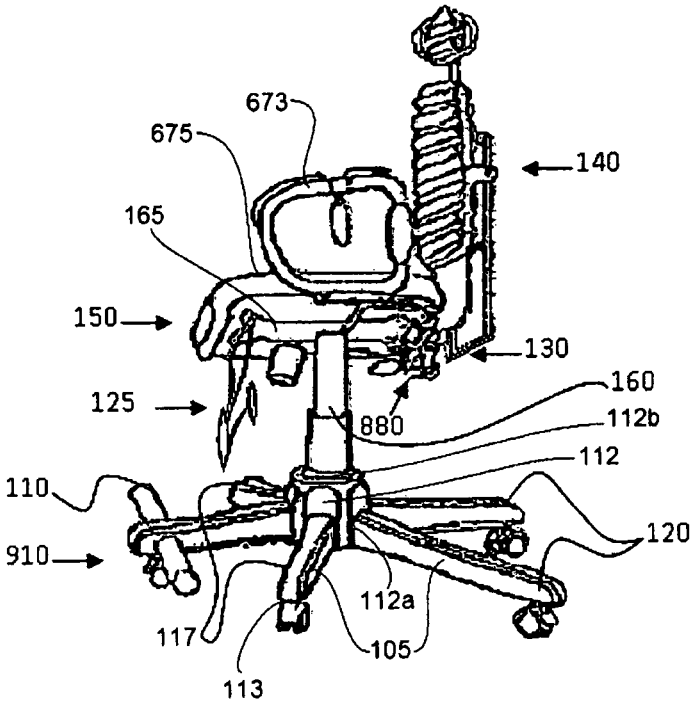
FIG. 1A is a depiction of this present embodiment's left perspective view.
Figure 1B:
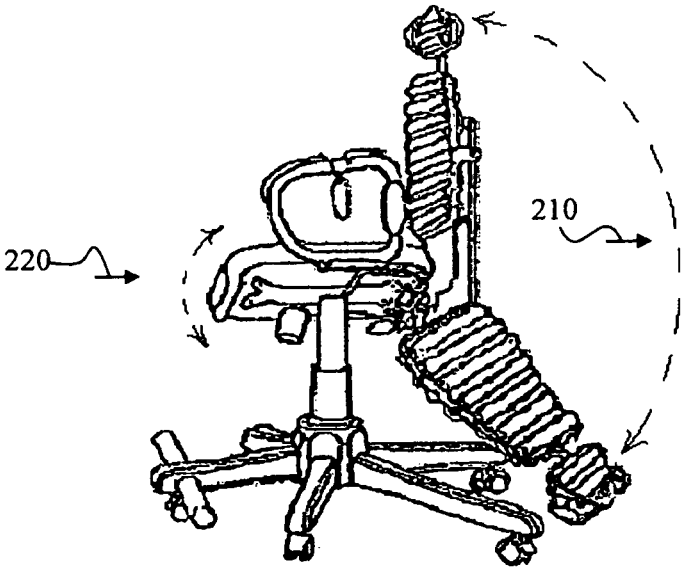
FIG. 1B is a depiction of this present embodiment's left perspective operational view of this present embodiment's backrest and seat articulation.
Figure 2:
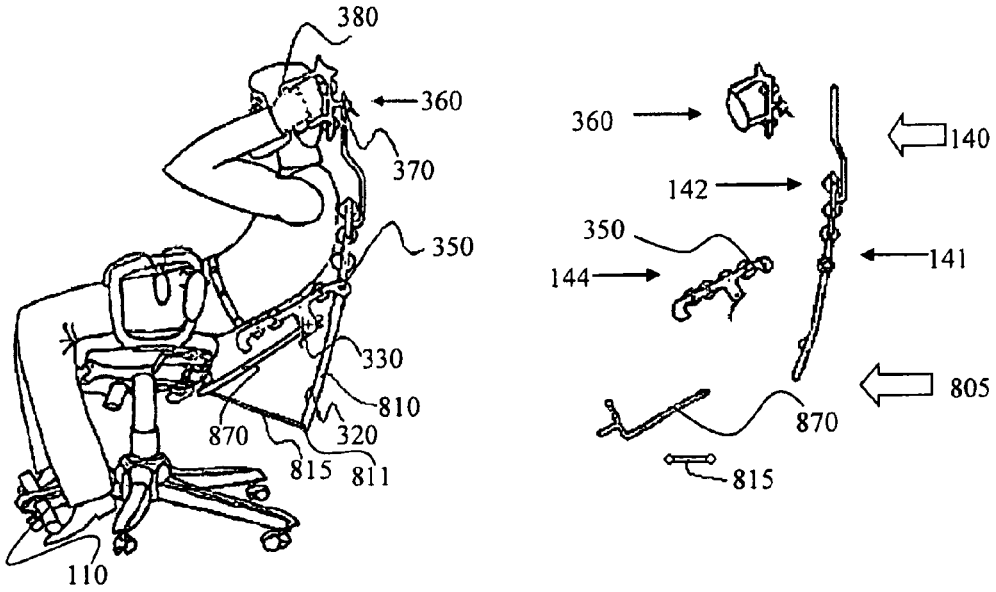
FIG. 2 depicts this present embodiment's left perspective operational view of this present embodiment's backrest being hinged.
Figure 3:
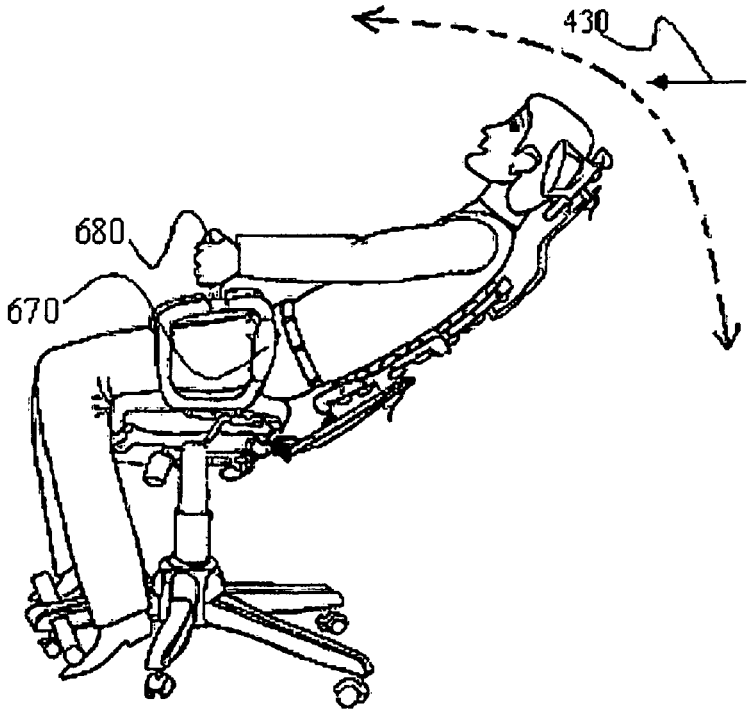
FIG. 3 is a depiction of this present embodiment's left perspective operational view of this present embodiment's handgrips and backrest support.
Figure 4:
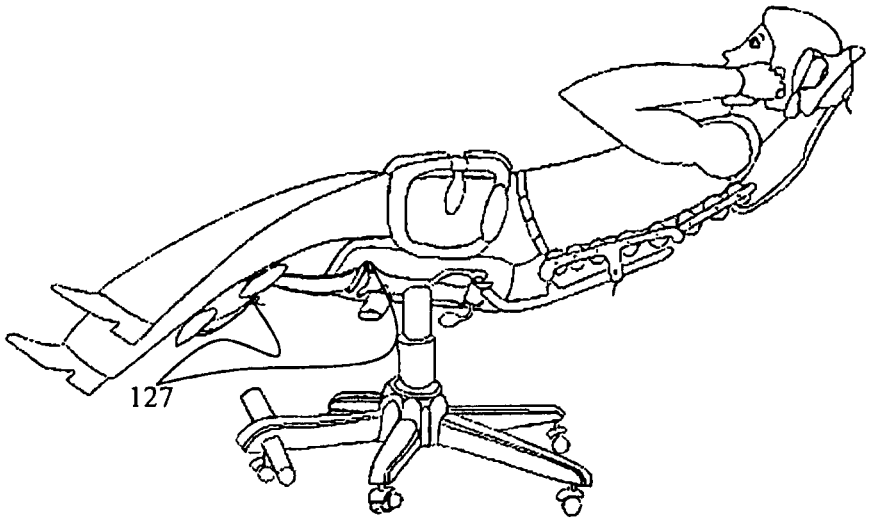
FIG. 4 is a depiction of this present embodiment's left perspective operational view of this present embodiment's recline and leg rest feature.
Figure 5:
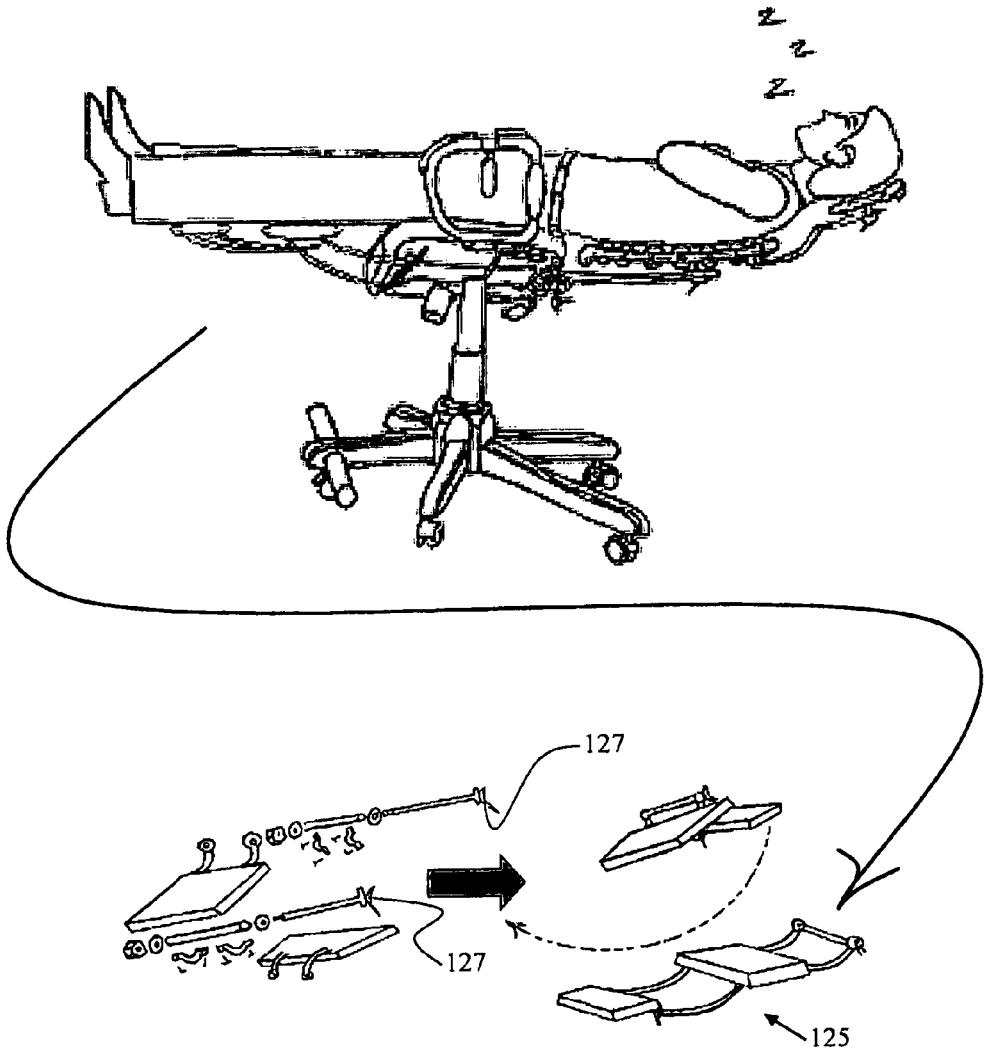
FIG. 5 depicts this present embodiment's left perspective operational view of backrest support and leg rest locked in the horizontal position to allow the user to lay flat.
Figure 6:
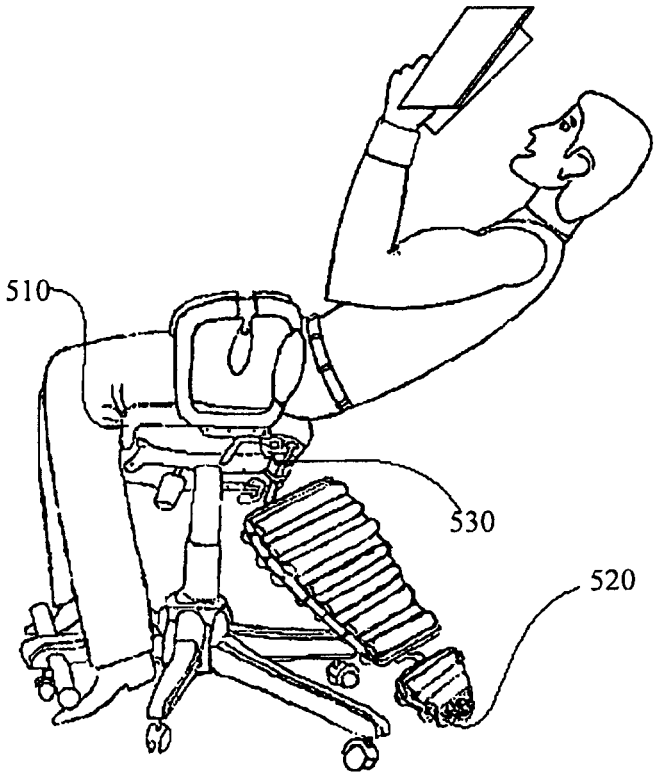
FIG. 6 is a depiction of this present embodiment's left perspective operational view of this present embodiment's curved seat front cushion used to stabilize the user while user is exercising and reading or on the phone.
Figure 7A:
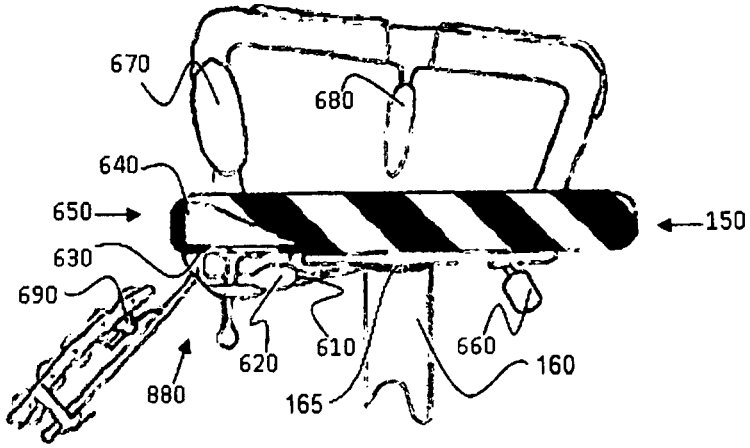
FIG. 7A is a depiction of this present embodiment's right side cross sectional view of this present embodiment's spine stabilizer airbag, airbag pump, air release button, seatback hinge lock release lever, and workout sensor.
Figure 7B:
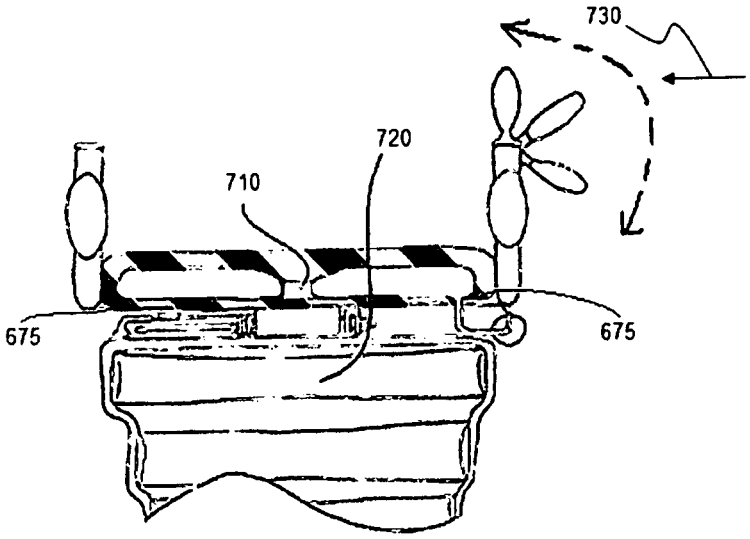
FIG. 7B is a depiction of this present embodiment's rear cross sectional view of this present embodiment's spine stabilizer air bag with tailbone comfort notch, comfort concave backrest support rollers, and hand grip articulation.
Figure 8:
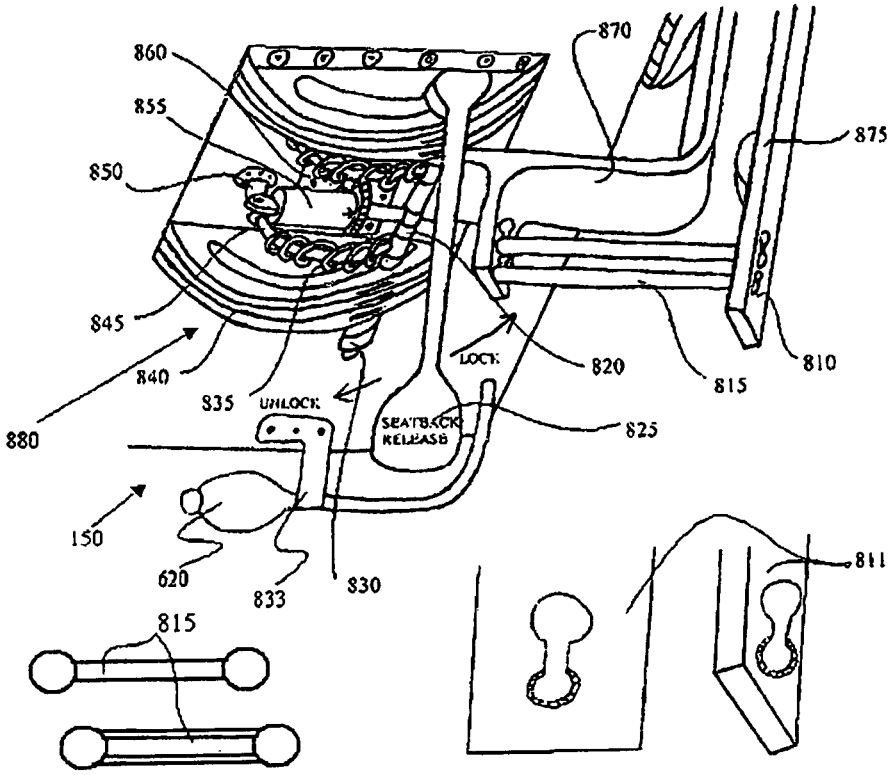
FIG. 8 depicts this present embodiment's perspective bottom view of this present embodiment's seat underside, seatback release, elastic cords, and cord notches.
Figure 9A:
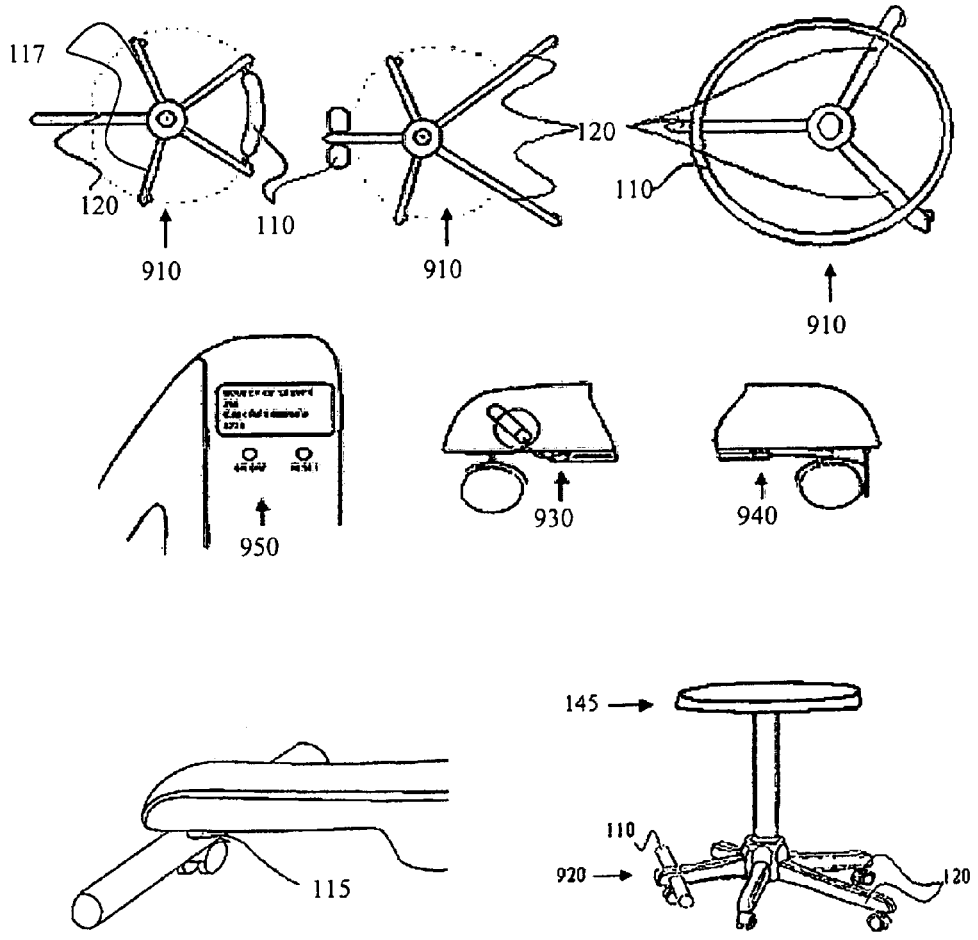
FIG. 9A depicts this present embodiment's elevated view of this present embodiment's bases, perspective elevated view of this present embodiment's armrest display with USB output conventional (not shown), side view of the wheel lock actuator and wheel locks, securing member and or methods for securing user's feet and locking at least one wheel, and a depiction of a stool embodiment.
Figure 9B:
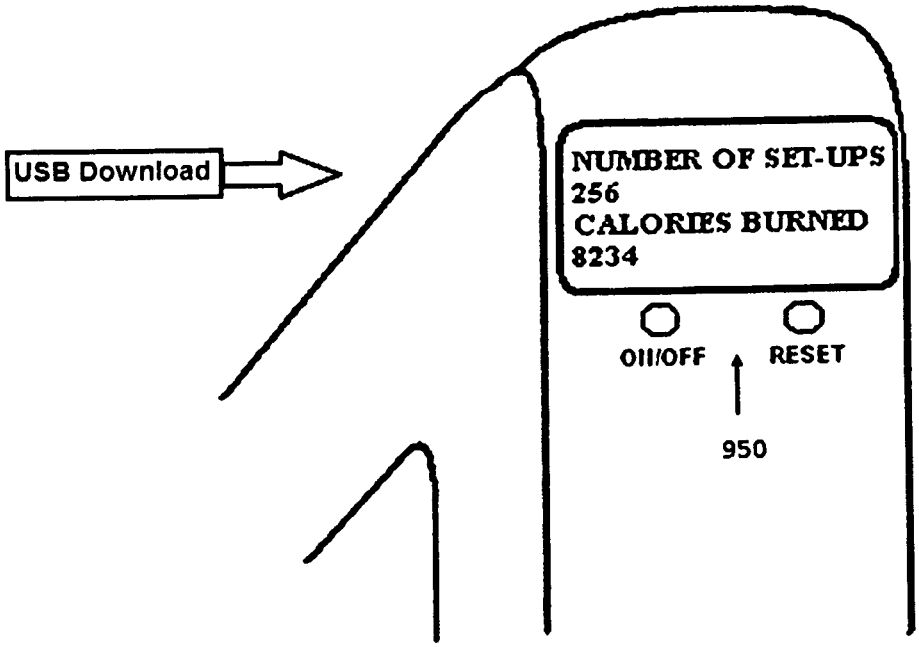
FIG. 9B is an enlarged depiction of an armrest display 950 initially depicted in FIG. 9A. The display and downloading user data is a conventional USB 975.
Figure 10:
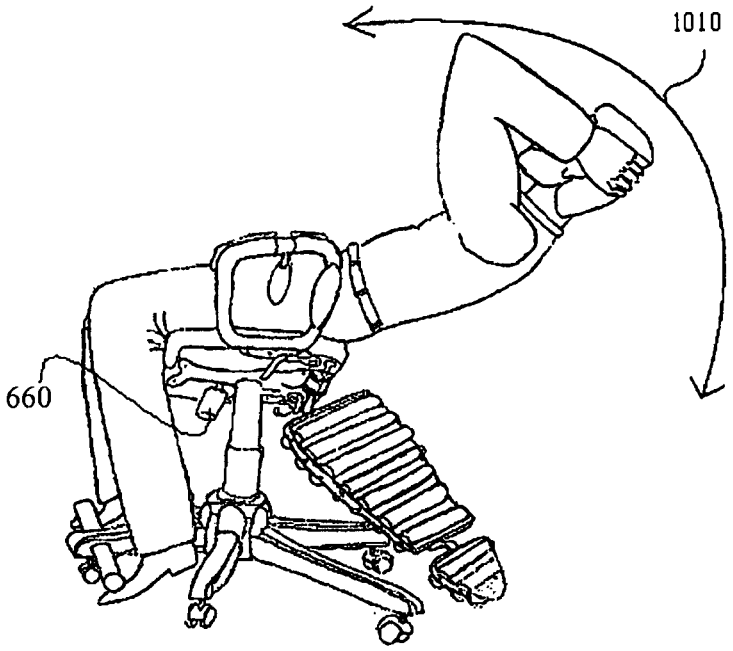
FIG. 10 is a depiction of this present embodiment's left perspective operational view of this present embodiment's use for exercising.
Figure 11A:
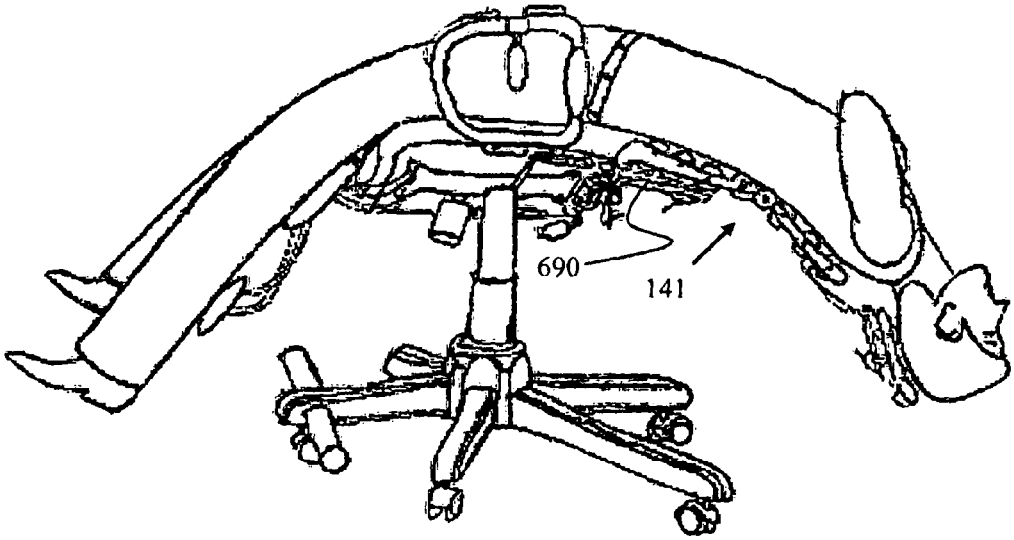
FIG. 11A is a depiction of this present embodiment's left perspective operational view of this present embodiment's use to stretch the user's body.
Figure 11B:
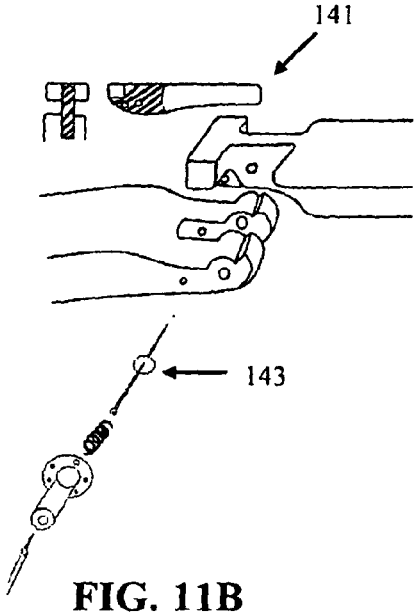
FIG. 11B depicts this present embodiment's elevated side perspective view of this present embodiment's seatback lockable hinge and seatback hinge lock.

| DRAWINGS-REFERENCE NUMERALS | |
|---|---|
| 105 | Plurality of coaster wheels |
| 110 | Means of securing human feet |
| 112 | Disposed center |
| 112a | Means for joining support members first ends |
| 112b | Means for joining and end of an elongated support member to a disposed center of a base |
| 113 | Means for joining support members second ends to coaster wheels |
| 115 | Means of securing human feet and locking at least one wheel |
| 117 | Plurality of support members |
| 120 | Predetermined elongated support member |
| 125 | Leg rest |
| 127 | Leg rest locks |
| 130 | Seatback tension adjust |
| 140 | Seatback |
| 141 | Seatback lockable hinge |
| 142 | Seatback upper unit |
| 143 | Seatback hinge lock |
| 144 | Seatback lower unit |
| 145 | Stool |
| 150 | Seat |
| 160 | Elongated support member |
| 165 | Means for joining seat underside to an end of elongated support member |
| 210 | Depicts seatback articulations |
| 220 | Depicts seat articulations |
| 320 | Seatback lower unit stop bumper |
| 330 | Seatback adjust |
| 350 | Means of hinging |
| 360 | Headrest with handgrips |
| 370 | Headrest adjust |
| 380 | Headrest handgrips |
| 430 | Articulation of user with present embodiment's exercise assists |
| 510 | Curved seat front |
| 520 | Headrest feet |
| 530 | Seat height adjust and lean lock |
| 610 | Deflate button |
| 620 | Hand pump |
| 630 | Workout sensor |
| 640 | Spine stabilizer air bag |
| 650 | Cradle |
| 660 | Lean tension adjuster |
| 670 | Stationary handgrips |
| 673 | Armrest |
| 675 | Means for joining armrest |
| 680 | Adjustable handgrips |
| 690 | Seatback hinge lever |
| 710 | Tailbone notch |
| 720 | Concave seatback rollers |
| 730 | Depicts adjustable handgrip articulations |
| 805 | Means of providing tension |
| 810 | Seatback tension arm |
| 811 | Stretch cord notch |
| 815 | Stretch cords |
| 820 | Seatback support cylinder |
| 825 | Seatback lever |
| 830 | Lock pin nut |
| 835 | Seatback springs |
| 840 | Tracks |
| 845 | Seatback spring guide |
| 850 | Strut Hinge |
| 855 | Seatback strut |
| 860 | Seatback support hinge |
| 870 | Seatback support |
| 875 | Seatback tension arm |
| 880 | Means of locking and releasing seatback |
| 910 | Wheeled base |

-continued

| DRAWINGS-REFERENCE NUMERALS | |
|---|---|
| 930 | Wheel lock actuator |
| 940 | Wheel locks |
| 950 | Armrest display |
| 975 | Display and USB download |
| 1010 | Sit-up exercises |

DETAILED DESCRIPTION OF THE DRAWINGS

Specifications

FIG. 100 is a depiction of this present embodiment's left perspective view. This present embodiment includes a plurality of coaster wheels 105 and a plurality of support members 117 that make up a wheeled pedestal base referred to from here on as a base 910. This present embodiment further includes an elongated support member 160, a seat 150, and a seatback 140. The wheeled base 910 has a means of securing human feet 110, disposed center 112, means for joining support members first ends 112*a*, means for joining an end of elongated support member to a disposed center of base 112*b*, and means for joining support members second ends to coaster wheels 113. The seatback 140 joins the seat 150 underside by locking and releasing apparatus 880.

The seat 150 of FIG. 100 can be best seen in FIG. 600 and FIG. 700. The seat 150 of FIG. 600 has an upper side, under side, front side, rear side, right side, and left side as well as a center. The seat 150 has a cushioned upper side. The seat 150 has cradle 650 which is made up of a spine stabilizer air bag 640 with a tailbone notch 710 and a workout sensor 630. The spine stabilizer air bag 640 is attached to a hand pump 620 which has a deflate button 610. The seat 150 has attached to it a means for joining armrest 675 which is a member that joins an armrest 673 on its right side and an armrest on its left side, the armrests each having stationary handgrips 670 and adjustable handgrips 680. One of the armrests has an armrest display 950 of FIG. 900. The seat 150 underside has a lean tension adjuster 660 and locking and releasing apparatus 880. The seat underside joins a strut, from here on will be referred to as an elongated support member 160, perpendicularly so that the seat 150 is supported parallel to the base 910. The seat 150 underside can best be seen in FIG. 800, which also shows locking and releasing apparatus 880 and a seatback support 870. The seatback support 870 has two ends wherein one end joins to the locking and releasing apparatus 880 and the other end joins a seatback 140 by a seatback adjust 330.

The seatback 140 joins the seatback support 870 by a seatback adjust 330 that can best be seen in FIG. 300. The seatback support 870 is attached to the seatback support hinge 860 of FIG. 800 on its other end. The seatback 140 is made up of a seatback upper unit 142 and a seatback lower unit 144 that joins together by a means of hinging 350. The upper seatback tension arm 810 with a stretch cord notch 811 on one end that a multiple of stretch cords 815 can be attached to. The upper seatback tension arm 810 has a seatback lower unit stop bumper 320 to stop the seatback upper unit 142 from bending at the means of hinging 350 when user leans back. The upper seatback tension arm 810 has a seatback upper unit 142 with an arm to join a headrest with handgrips 360 by a headrest adjust 370.

Some other features of this present embodiment is that the means of securing human feet 110 secure the user's feet while keeping the distance between the user's feet close, while at the same time keeping the distance between the user's knees close to each other. This feature allows this present embodiment to secure the user comfortably without causing stress or strain to the user's joints such as twisting or torquing the user's ankles or knees when the user performs exercises. Another feature is that the user's knees are kept in a vertical line with the user's feet and shoulders; which prevents any stress or strain on the user's joints and muscles that would result in injury. Other features are the use of a two point contact securing method used to secure the user when the user leans back to perform exercises or stretches. Means of securing human feet 110 is the first contact point and it by itself is not enough to keep the user from falling. To prevent the user from falling, a seat front is needed that is rigid, secure, and comfortable such as a curved seat front 510. The curved seat front 510 is the second contact point that is used to keep the user from falling back. When the user leans back with his/her feet secured, there is nothing keeping the user's body from falling back. To prevent the user from falling back, a seat front is needed to secure the user by applying a force to the back of the user's knees. This force will keep the user from sliding or falling off the seat.

Operation

FIG. 300 is a depiction of this present embodiment's usage. The user can be seated and lock their feet by means of securing human feet 110. Means of securing human feet 110 stabilize the user and will keep the user's legs from moving upwards. Once the user is seated and their feet locked in place, the user can grab the handgrips 380 and pull the headrest with handgrips 360 forward. The seatback upper unit 142 will be allowed to be pulled forward by hinging on the means of hinging 350 while the user's back keeps seatback lower unit 144 in place. The stretch cord 815 may provide additional resistance for the user to overcome in order to exercise their upper abdominal.

FIG. 400 is best described with the assistance of FIG. 800. FIG. 400 is another depiction of this present embodiment's usage. The user can lock their feet in place by using means of securing human feet 110 then the user can unlock seatback by locking and releasing apparatus 880 allowing the seatback 140 to move freely. The seatback 140 will assist the user by pushing on the user's back with the use of seatback springs 835. The user can also deploy adjustable handgrips 680 and stationary handgrips 670 for assistance. The user can also adjust the tension of the seatback strut 855 for additional assistance. In this method, the user is helped upward and fights the tension of both seatback springs 835 and seatback strut 855 in the downward motion. A full range of motion articulation can be realized with the present embodiment's assistance 430. The user is kept from falling backwards by the use of predetermined elongated support members 120.

FIG. 450 is yet another depiction of this present embodiment's usage. The user releases the locking and releasing apparatus 880 to lower the seatback 140 so that the seatback 140 is parallel to the predetermined elongated support members 120. The user can then lock locking and releasing apparatus 880 to lock the seatback 140 to a horizontal position. The user can then unlock both of the leg rest locks 127 and push the leg rest 125 out and lock the leg rest locks 127 so that the leg rest 125 are in the horizontal position to create a flat plain for the user's legs. The predetermined elongated support members 120 will stabilize the user. The leg rest 125, the seat 150, the seatback 140, and the headrest with handgrips 360 will give the user a flat plane to rest on.

FIG. 500 is yet another depiction of the present embodiment's usage. The user unlocks locking and releasing apparatus 880 and moves seatback 140 completely to the floor so that the headrest feet 520 touch and rest completely on the floor. The user adjusts the height of the elongated support member 160 by use of a seat height adjust and lean lock 530 so that curved seat front cushion 510 is behind their knees. The user locks his/her feet in means of securing human feet 110 and lock the seat height adjust and lean lock 530 to keep the seat 150 from tilting. The rearward protruding predetermined elongated support members 120 support the user and keep the user from falling. The user can then stretch their legs and abdomen and can workout against gravity by the modulation of user's upper body 540. The user can lean back while reading a book or on the phone fighting against gravity to workout.

FIG. 1000 is yet another depiction of this present embodiments usage. The user can move the seatback 140 out of their way as described above in FIG. 500 and unlock the seat height adjust and lean lock 530 to allow the seat 150 to tilt back and cradle the user's back. The tension on the tilt can be adjusted using the lean tension adjuster 660. Once the user is locked in using means of securing human feet 110, the user can perform seated sit-up exercises 1010.

FIG. 1100 is yet another depiction of the present embodiment's usage. The user can release the seatback hinge lock 143 by squeezing on the seatback hinge lever 690 to release the seatback lockable hinge 141 to allow the seatback upper unit 142 to be lowered so that the user can perform stretches.

ADVANTAGES

This present embodiment has several advantages over prior art some of the advantages will be made apparent below:

a) This present embodiment looks similar to a traditional office chair and can be placed in an office environment without looking awkwardly conspicuous.

b) This present embodiment is the only office chair with a coaster wheeled pedestal base to have a means of securing human feet 110, locking and releasing apparatus 880 so that the seatback can be pivotally lowered to rest as to touch the floor, and a means of hinging 350 to allow the seatback itself to hinge in two. Making this embodiment a truly innovative office chair whereby giving its user a safe, fast, convenient, and fun way of working out or stretching without having the user lay on the floor.

c) This present embodiment allows the user to continuously work their abdomen anytime during the day or night and also allows the use of this present embodiment as an office chair, giving the user continuous opportunity throughout a typical workday to workout.

d) This present embodiment is the only office chair that provides comfortable seating for the user and can be easily used without having to be laboriously manipulated or having the user add or remove parts to exercise, therefore making this embodiment not just an office chair with a convenient workout capability but also a constant reminder to work out.

e) Because this present embodiment is an office chair that provides an easy and convenient workout and stretch capability that the user sits on throughout the day, this present embodiment eliminates excuses of not having the time to workout.

f) This present embodiment is the only embodiment that is an office chair with a coaster wheeled pedestal base, which has a means of securing human user's feet and a backrest that can be hinged in two to provide the user with the ability to stretch and workout. The user can workout their entire abdomen, not just their lower or upper.

CONCLUSION, RAMIFICATIONS, AND SCOPE

This present embodiment provides its user with a seat for sitting, working, and a means to safely, easily, and conveniently lay flat or perform a variety of exercises and stretches. Furthermore, the user can perform exercises and stretches while reading, on the phone, working on the computer, or such. This present embodiment also provides the user with a quick, convenient, and easy access to a high quality workout. This present embodiment replaces multiple articles of furniture and workout equipment to provide the user with a clutter free, consolidated, high quality all-in-one article of furniture. Because this present embodiment offers a seat that includes workout, stretch, and rest capabilities and is readily available for the user, it can help the user become fit or maintain their fitness. Since this present embodiment looks similar to a traditional office chair and not a workout machine, the user can workout and not worry about leaving this present embodiment out in the open.

Many examples, depictions, drawings, specifications, and such have been given in general regarding this present embodiment. These examples, depictions, drawings, specifications, and such must not be used in limiting the scope of this present embodiment. For example, altering or evolving this present embodiment can realize other embodiments, such as making means of securing human feet 110 without a cushion or making it more of a paddle, using springs in place of the stretch cords 815, eliminating the cushioned top on the seat 150, and/or using a mesh, eliminating the seat 150 center, removing the armrests or other numerous components and parts. Other examples such as using different materials, sizes, colors, making all the pedestal legs elongated or having one big ring around the base as a means to stabilize the user, altering, adding, or eliminating parts to perform similar functions, etc. Therefore, the scope of this present embodiment should be determined by the appended claims and their legal equivalents, rather than by the examples given.

I claim:

1. An article of furniture configured for a human to be seated, said article comprising:

a base,
- said base comprising:
  - a plurality of support members each having a first end and a second end,
  - a plurality of coaster wheels,
  - a securing member for securing human feet,
  - said plurality of support members said first ends join so as to be equally disposed and protrude outwards from a disposed center,
  - at least one of said plurality of support members said second end comprises the securing member for securing human feet,
  - at least one of said plurality of support members are elongated in an opposing direction of said securing member for securing human feet so as to protrude a predetermined length greater than the other plurality of support members,
  - said plurality of support members said second ends join said plurality of coaster wheels so as to allow said plurality of coaster wheels to rest securely on a floor, said plurality of coaster wheels supporting said plurality of support members off said floor and allowing said plurality of support members to rest on said plurality of coaster wheels;

a seat,
- said seat comprising:
  - a seat upper side,
  - a seat underside;

an elongated support member,
- said elongated support member comprising:
  - a third end, a fourth end;

said seat underside joins substantially perpendicularly to said third end of said elongated support member so as to be able to support said seat;

said fourth end of said elongated support member joins substantially perpendicularly to said disposed center of said base;

wherein said seat is supported substantially parallel to said base and allow said coaster wheels to rest securely on said floor;

a seatback;

said seatback further comprising:

a seatback upper unit;

a seatback lower unit;

a locking and releasing apparatus;

a seatback lockable hinge;

a seatback tension arm;

a seatback support;

a stretch cord;

said seatback support joins said seatback lower unit;

said seatback lower unit joins said seatback tension arm;

said seatback lockable hinge joins said seatback tension arm and said seatback upper unit;

said locking and releasing apparatus joins said seat underside and said seatback support, wherein said locking and releasing apparatus allows said seatback support to unlock and be pivotally lowered wherein allowing said seatback to rest on said floor as to touch said floor;

wherein said locking and releasing apparatus is configured to relock said seatback to any position from full upright to fully down to rest on said floor as to touch said floor;

said seatback lockable hinge joins said seatback upper unit and said seatback tension arm at a point between said seatback upper unit and said seatback lower unit wherein allowing said seatback upper unit to hinge and be lowered away from said seat towards said floor;

wherein said stretch cord provides tension between said seatback support and seatback tension arm, said seatback upper unit further comprises a headrest with handgrips, said securing member for securing human feet preventing said human feet from moving upwards wherein stabilizing said human when said human leans completely back to a horizontal position, said plurality of support members elongated in the opposing direction of said securing member for securing human feet so as to protrude a predetermined length greater than the other plurality of support members wherein providing stability for said human when said human leans back completely to a horizontal position.

2. The article of claim 1 said securing member for securing human feet comprises a mechanism for locking at least one coaster wheel.

3. The article of claim 1 further comprising an air bag and a hand pump with a deflate button.

4. The article of claim 1 further comprising a USB output for downloading user data.

5. The article of claim 1, further comprises a sensor.

6. The article of claim 1, further comprises at least one armrest:

said armrest comprising a stationary handgrip and an adjustable handgrip.

7. The article of claim 1, further comprises at least one stretch cord notch configured to accept at least one stretch cord.

8. The article of claim 1, said seat further comprising:

a display to display user data.

9. An article of furniture comprising:

a base comprising:

a securing member for securing human feet, a plurality of coaster wheels, a plurality of support members, said plurality of support members each having a first end and a second end and are predetermined in quantity, said plurality of support members are joined at said first ends and disposed evenly from a center, said plurality of coaster wheels are joined to said second ends of said plurality of support members so as to rest on said coaster wheels, wherein said coaster wheels sit securely on a floor, said securing member for securing human feet is joined to at least one of said support members or at least one of said coaster wheels, at least one of said plurality of support members is elongated a predetermined length greater than the other plurality of support members in an opposing direction of said support member joined to said securing member for securing human feet, an elongated support member having an upper end and lower end, said lower end of said elongated support member is joined perpendicularly to said center and said upper end of said elongated support member is joined to a seat suitable for human sitting;

said seat comprising:

a frontside, a backside, an underside, a first side, a second side, and a center, said first side and said second side are each joined to an armrest to secure each armrest vertically, said center of said seat comprise a cradle for cradling human tailbone, said cradle comprise a spine stabilizer air bag with tailbone notch;

a leg rest joined to said underside of said seat, said leg rest is configured to pivot and lock, at least one of said armrests further comprising a display for displaying and downloading user data, said underside of said seat is joined to a seatback so as to secure said seatback whereby allowing said seatback to pivot and lock;

said seatback comprising:

a seatback upper unit, a headrest with handgrips, a seatback lower unit, said seatback joins said seatback upper unit to said seatback lower unit to allow said seatback upper unit to hinge with tension, said headrest with handgrips joins said seatback upper unit to secure and adjust said headrest to said seatback upper unit;

said seat further comprises of a curved seat front, wherein said curved seat front and said securing member for securing human feet create a two point contact preventing said user from falling back by applying a force to the back of said user's knees and keeping said human feet from moving upwards.

10. The article of claim 9, said seatback upper unit is configured to be released by a seatback lockable hinge wherein allowing said seatback upper unit to be lowered from said seatback lower unit towards said plurality of support members that is elongated a predetermined length greater than the other plurality of support members.

11. An article of furniture of further comprising:

a base, said base comprising:

a plurality of support members each having a first end and a second end;

a plurality of coaster wheels;

said plurality of support members said first ends join so as to be equally disposed and protrude outwards from a disposed center;

said plurality of support members said second ends join said plurality of coaster wheels;

a seat having a seat upper side and a seat underside;

an elongated support member having a third end and a fourth end;

wherein said seat underside is configured to join said third end of said elongated support member so as to be able to support said seat;

wherein said fourth end of said elongated support member is joined to said base;

a securing member for securing human feet, said securing member for securing human feet is configured to have an upper side and an under side, said upper side of said securing member for securing human feet is joined to at least one of said plurality of support members that is not elongated greater than the other plurality of support members, said under side of said securing member for securing human feet is joined to at least one of said plurality of coaster wheels, wherein said securing member for securing human feet is joined to both said at least one of said plurality of support members that is not elongated greater than the other plurality of support members and at least one of said coaster wheels wherein said securing member for securing human feet, secures human feet and locks at least one of said coaster wheels, said at least one of said plurality of support members that is not joined to said securing member for securing human feet is elongated a predetermined length greater than the other plurality of support members in an opposing direction of said support member that is joined to said securing member for securing human feet.

12. A method for combining an article of furniture configured for a human to be seated, perform exercises, stretches, and maintain a flat stationary position, comprising the steps of:

providing a base, said base comprising:

providing a plurality of support members each having a first end and a second end, providing a plurality of coaster wheels, providing a securing member for securing human feet;

joining said securing member for securing human feet to at least one of said plurality of support members, joining said plurality of support members said first ends so as to be equally disposed and protrude outwards from a disposed center, elongating at least one of said plurality of support members in an opposing direction of said securing member for securing human feet to protrude a predetermined length greater than the other plurality of support members, joining said plurality of support members said second ends to said plurality of coaster wheels so as to allow said plurality of coaster wheels to rest securely on a floor, said plurality of coaster wheels lifting said plurality of support members off said floor and allowing said plurality of support members to rest on said plurality of coaster wheels;

providing a seat having an upper side an underside;

providing an elongated support member having a third end and a fourth end;

joining said seat underside substantially perpendicularly to said third end of said elongated support member so as to be able to support said seat;

joining said fourth end of said elongated support member substantially perpendicularly to said disposed center so as to allow said coaster wheels to rest securely on said floor;

wherein said seat is supported substantially parallel to said base;

providing a seatback, providing a seatback upper unit, providing a seatback lower unit, providing a locking and releasing apparatus, providing a seatback lockable hinge;

joining said seat underside and said locking and releasing apparatus, joining said locking and releasing apparatus to said seatback;

joining said seatback to said seatback lockable hinge;

joining said seatback lockable hinge to said seatback upper unit and said seatback lower unit wherein allowing said seatback upper unit to hinge from said seatback lower unit at a point between said seatback upper unit and said seatback lower unit, joining said seatback lockable hinge and said seatback upper unit and said seatback lower unit wherein seatback lockable hinge provides tension to said seatback upper unit;

wherein said seatback upper unit comprising:

providing a headrest with handgrips;

providing a curved seat front;

joining said curved seat front and said seat, whereby said securing member for securing human feet stabilizes said human and keeps said human feet from moving upward, said securing member for securing human feet further keeps the distance between said human user's feet close to each other, while keeping the user's knees in a vertical line with said human user's feet and shoulders and secures said user comfortable without causing stress or strain to said user's joints, without twisting or torqueing said user's ankles or knees;

wherein said locking and releasing apparatus allows said seatback to unlock and be pivotally lowered to rest on said floor as to touch said floor;

wherein said locking and releasing apparatus is further configured to relock said seatback to any position from full upright to fully down to rest on said floor as to touch said floor;

said at least one of said plurality of support members elongated in the opposing direction of said securing member for securing human feet wherein providing stability for said human when said human leans back completely to a horizontal position;

said curved seat front and said securing member for securing human feet create a two point contact preventing said user from falling back by applying a force to the back of said user's knees and keeping said human feet from moving upwards.

13. The method of claim 12, said seatback further:
providing concave seatback rollers.

14. The method of claim 12, said securing member for securing human feet further comprising:
providing a wheel lock;
joining said wheel lock to at least one of said plurality of coaster wheels;
wherein said securing member for securing human feet actuates the locking or unlocking of at least one of said plurality of coaster wheels.

15. The method of claim 12, said seat further comprising:
providing a first side and a second side,
providing an armrest,
providing stationary handgrips,
providing adjustable handgrips,
joining said first side and said second side each to said armrest so as to secure each said armrest vertically;
joining said stationary handgrips and said adjustable handgrips to said armrest;
wherein at least one of said armrest further comprising:
providing a display for displaying and downloading user workout data.

16. An article of furniture comprising:
a base,
said base comprising:
a plurality of support members each having a first end and a second end,
a plurality of coaster wheels,
said plurality of support members said first ends join so as to be equally disposed and protrude outwards from a disposed center,
said plurality of support members said second ends join said plurality of coaster wheels,
a seat having a seat upper side and a seat underside;
an elongated support member having a third end and a fourth end;
wherein said seat underside is configured to join said third end of said elongated support member so as to be able to support said seat;
wherein said fourth end of said elongated support member is joined to said base;
a securing member for securing human feet;
said securing member for securing human feet directly joins to at least one of said plurality of support members that is not elongated greater than the other plurality of support members;
at least one of said plurality of support members that is not joined to said securing member for securing human feet is donated a predetermined the other plurality of support members in an opposing direction of said support member that is directly joined to said securing member for securing human feet.

17. The article of furniture of claim 16 further comprises at least one armrest:
said armrest comprising a stationary handgrip and an adjustable handgrip.

18. The article of furniture of claim 16 said seat further comprises a seatback, said seatback is configured to be lowered towards said plurality of support members that is elongated a predetermined length greater than the other plurality of support members.

19. The article of furniture of claim 18, said seatback further comprises: seatback rollers.

20. The article of furniture of claim 16, said seat further comprises:
a leg rest, said leg rest joined directly to said underside of said seat.

21. An article of furniture comprising:
a base
said base comprising:
a plurality of support members each having a first end and a second end,
a plurality of coaster wheels;
said plurality of support members said first ends join so as to be equally disposed and protrude outwards from a disposed center,
said plurality of support members said second ends join said plurality of coaster wheels;
a seat having a seat upper side and a seat underside;
an elongated support member having a third end and a fourth end;
wherein said seat underside is configured to join said third end of said elongated support member so as to be able to support said seat;
wherein said fourth end of said elongated support member is joined to said base;
a securing member for securing human feet;
said securing member for securing human feet is joined to at least one of said plurality of support members that is not elongated greater than the other plurality of support members,
said securing member for securing human feet further comprises a wheel lock actuator for locking at least one wheel lock,
wherein said securing member for securing human feet, secures human feet and locks at least one of said coaster wheels,
at least one of said plurality of support members that is not joined to said securing member for securing human feet is elongated a predetermined length greater than the other plurality of support members in an opposing direction of said support member that is joined to said securing member for securing human feet,
wherein at least one of said coaster wheels comprises a wheel lock,
wherein said securing member for securing human feet actuates at least one of said wheel locks.

* * * * *